US009869055B2

(12) United States Patent
Zephir et al.

(10) Patent No.: US 9,869,055 B2
(45) Date of Patent: Jan. 16, 2018

(54) ROLLING HAMPER

(71) Applicant: United Comb & Novelty Corporation, Leominster, MA (US)

(72) Inventors: Edward Zephir, Leominster, MA (US); Ronald Audet, North Smithfield, RI (US); Sean Curran, Leominster, MA (US); Rebecca Foster, West Lebanon, NH (US)

(73) Assignee: United Comb + Novelty Corporation, Leominster, MA (US)

( * ) Notice: Subject to any disclaimer, the term of this patent is extended or adjusted under 35 U.S.C. 154(b) by 0 days.

(21) Appl. No.: 15/235,930

(22) Filed: Aug. 12, 2016

(65) Prior Publication Data

US 2017/0137992 A1 May 18, 2017

Related U.S. Application Data

(60) Provisional application No. 62/204,087, filed on Aug. 12, 2015.

(51) Int. Cl.
*D06F 95/00* (2006.01)

(52) U.S. Cl.
CPC ..... *D06F 95/002* (2013.01)

(58) Field of Classification Search
CPC ..... D06F 95/002; B62B 1/006; B62B 1/10; B65F 1/02
See application file for complete search history.

(56) References Cited

U.S. PATENT DOCUMENTS

| | | | | |
|---|---|---|---|---|
| 3,366,397 | A * | 1/1968 | Zeilstra | B62B 1/10 280/47.26 |
| 4,050,708 | A | 9/1977 | Samardzija et al. | |
| 5,511,807 | A | 4/1996 | Snyder | |
| 6,036,204 | A | 3/2000 | Craft et al. | |
| D491,327 | S | 6/2004 | Gambino | |
| D532,568 | S | 11/2006 | Rodriguez | |
| 7,185,783 | B1 * | 3/2007 | Miller | B65F 1/14 206/515 |
| D544,159 | S * | 6/2007 | McCoy | B62B 1/006 D32/37 |
| 7,494,136 | B2 * | 2/2009 | Alves | A45C 3/04 280/33.991 |
| 8,297,629 | B2 * | 10/2012 | Gimeno Verdejo | A45C 13/385 280/33.998 |
| D706,012 | S * | 5/2014 | Degnan | D34/16 |
| D715,512 | S * | 10/2014 | Subiros Berenguer | D34/24 |
| D720,913 | S * | 1/2015 | Subiros Berenguer | D34/24 |
| 9,108,655 | B2 * | 8/2015 | Sebastian | A47F 10/04 |
| 2001/0045371 | A1 * | 11/2001 | Ordonez | B65F 1/02 206/499 |
| 2006/0208439 | A1 * | 9/2006 | Depasquale | B62B 1/006 280/47.17 |

(Continued)

OTHER PUBLICATIONS http://sbshoppingbasket.com/en/product/70-liter-single-piece-rolling-basket/.

*Primary Examiner* — Hau V Phan
(74) *Attorney, Agent, or Firm* — Brian M. Dingman; Dingman IP Law, PC

(57) ABSTRACT

A rolling hamper with a body with two sides, a front, a bottom and an expanded back portion. The body includes ventilation holes which may have fortified edges to avoid hazards for users. Wheels are removably coupled at the two back corners so that the hamper can be tipped back and rolled.

13 Claims, 12 Drawing Sheets

(56) References Cited

U.S. PATENT DOCUMENTS

| | | | | |
|---|---|---|---|---|
| 2011/0095496 | A1* | 4/2011 | Kassab Arabo | B62B 1/006 280/33.992 |
| 2011/0127737 | A1 | 6/2011 | Lee | |
| 2013/0105489 | A1* | 5/2013 | Burgess | D06F 95/002 220/533 |

* cited by examiner

ROLLING HAMPER

CROSS-REFERENCE TO RELATED APPLICATION

This application claims benefit from U.S. Provisional Patent Application No. 62/204,087, filed 12 Aug. 2015, the contents of which are incorporated herein by reference.

FIELD

This disclosure relates to hampers used to store and transport items such as laundry and other personal articles.

BACKGROUND

Hampers provide a segregated space for the storage of a variety of items, however movement of the stored items can be laborious, especially when the contents are heavy. Wheeled hampers have been available for some time, however they are constructed with multiple molding processes and multiple pieces which adds to the cost of manufacturing, the efficiency of storage and display by retailers, the complication of use and the potential instability of the hamper for the end user.

SUMMARY

There is a need for a sturdy rolling hamper with a one-piece molded body that utilizes one-piece wheel/axle components which easily snap into place within the hamper body. Such a hamper would be easily and efficiently manufactured, nested with additional hampers of the same design, and maneuvered easily and confidently by a user since the body and handle are a single molded piece.

This disclosure relates to a rolling hamper which allows a user to store and transport items such as laundry and other personal articles with ease. Items may be stored in this semi-stationary rolling hamper when the bottom of the hamper is resting on the floor. The rolling hamper body is a one-piece molded item with two or more wheels removably coupled to the lower rear portion of the hamper to allow for simplified manufacturing, easy maneuvering and compact retail storage and display. The rolling hamper may be easily moved by tilting the rolling hamper body onto its wheels to allow movement of its contents without lifting. The rolling hamper may also be navigated up and down stairs as its wheels maneuver the rolling hamper body beyond the edges of stairs, protecting the finish of the stairs and avoiding scratches on the rolling hamper body.

In one aspect, the rolling hamper includes a one-piece molded body with two opposing sides, a front portion, a rear portion, a bottom and an open top. The hamper also features at least two wheels coupled to the lower rear portion of the hamper body. The rear portion of the body may comprise an extended upper area to allow a user to manipulate the hamper with little to no forward bending. The front and sides of the hamper may be essentially the same height, and all shorter than the extended upper area of the rear portion of the hamper, as measured from the bottom. The extended area of the rear portion may feature a molded reinforced handle through which one may grasp the rolling hamper to guide its movement. The sides and front may also feature molded reinforced handles for ease of use. The reinforced handles provide strength to the handle holes along with the elimination of sharp edges to avoid hazards for the user. The open top of the hamper may feature a rounded edge which may curve outward, away from the center of the open top. This provides added strength and stability to the hamper body, a smooth edge to avoid abrasions, and a lip in which one may grasp any portion of the upper lip of the hamper. Handle holes may also be featured under the top edges of the front and two sides of the hamper body to aid in lifting or directing the hamper.

In one embodiment, at least two wheels may be featured near the bottom of the rear portion of the rolling hamper to allow the user to tilt the hamper backward, toward the rear portion, so that the hamper and its contents may be maneuvered upon the wheels. Each wheel and axle may be manufactured as a one-piece component, reducing manufacturing costs and improving the ease with which one may secure the wheel/axle within an axle retaining hub.

Embodiments may include axle retaining assemblies, each with at least two axle retaining hubs. An axle retaining hub may comprise two opposing undercuts which retain an axle. An axle diameter may be slightly larger than the spacing created between the two opposing undercuts. An axle may be retained by pushing it past the ends of the two opposing undercuts which flex away from each other to allow the axle to pass by them. Once the axle has passed through the spacing between the undercuts, the opposing ends of the undercuts may return to their original position, thereby retaining the axle. Each axle retaining hub may also include an axle stop which holds the axle in place once it has passed by the ends of the two opposing undercuts. Therefore, once an axle has been snapped into position within a hub, the axle is held in position by the axle stop and the two undercut ends. The axle may be easily removed by reversing the installation procedure. The undercuts are produced with the use of straight moldings so that undercut release devices are not necessary in the creation of the undercuts. This procedure removes multiple steps within the manufacturing process, thereby streamlining the manufacture of the axle assemblies and reducing costs. The axle retaining assemblies may be utilized in a variety of designs which require the use of wheels.

Embodiments may include one of the following features, or any combination thereof. Handles, wheels and ventilation slots may be located in a variety of places throughout the body of the rolling hamper.

DETAILED DESCRIPTION

Figure 1:
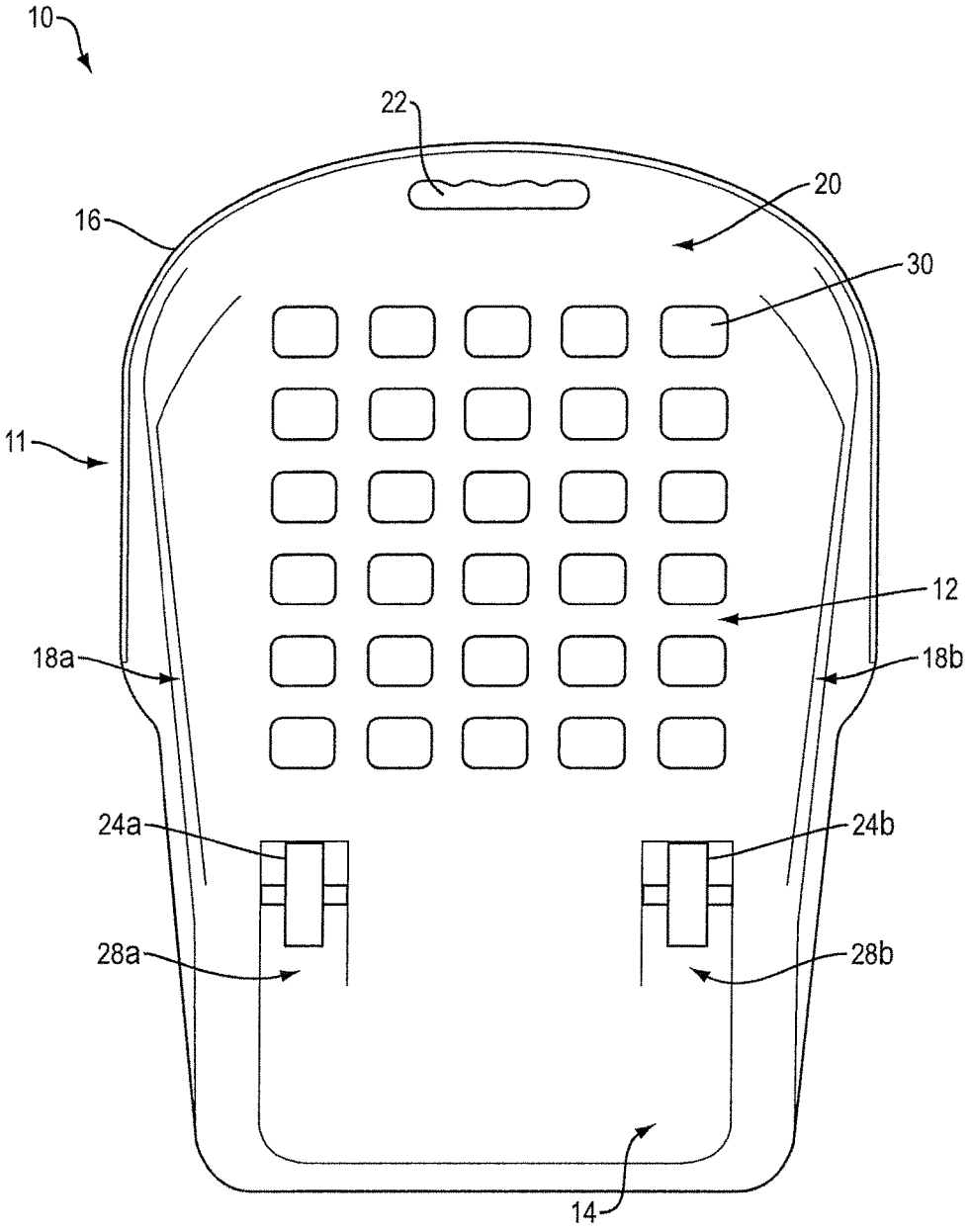
FIG. 1 is rear-bottom perspective view of a rolling hamper.

FIG. 1 is a perspective of a rolling hamper 10 with body 11 that has a rear portion 12 and bottom 14. Rear portion 12 has an upper rim 16 that continues along the tops of the right and left sides 18*a* and 18*b*, respectively. Also, an extended upper area 20 of the rear portion 12 features a handle opening 22 just below rim 16. Opening 22 allows a user to grasp the hamper 10 in order to move it or steer it upon the wheel/axle components 24*a* and 24*b* which are located at the lower part of the rear portion 12. The wheel/axle components 24*a* and *b* rotate freely within the wheel indentations 28*a* and 28*b*. Ventilation holes 30 can be seen throughout the rear portion 12 in order to allow airflow throughout the contents of the hamper 10.

Figure 2:
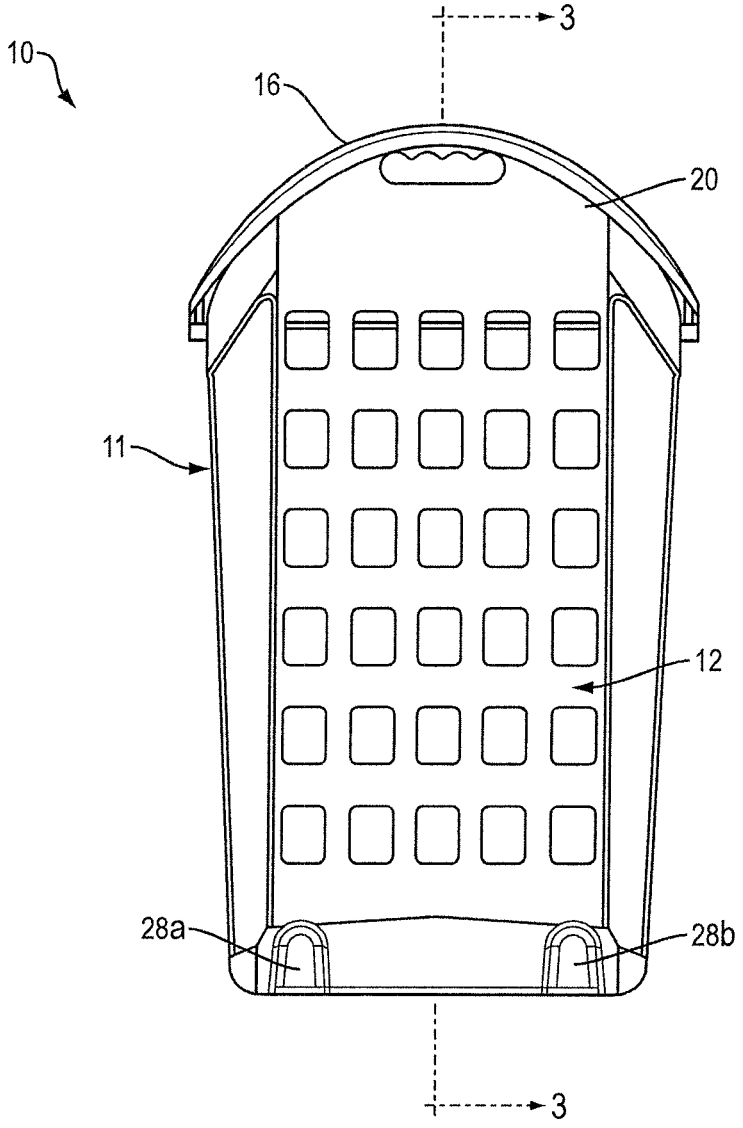
FIG. 2 is a rear view of the rolling hamper of FIG. 1, but without the wheels.

FIG. 2 shows the rear portion 12 of the rolling hamper 10. This embodiment features wheel indentations 28*a* and 28*b* in which wheels (not shown) may reside. In this view the upper rim 16 can be seen at the top of the extended area 20 in the upper part of the rear portion 12.

Figure 3:
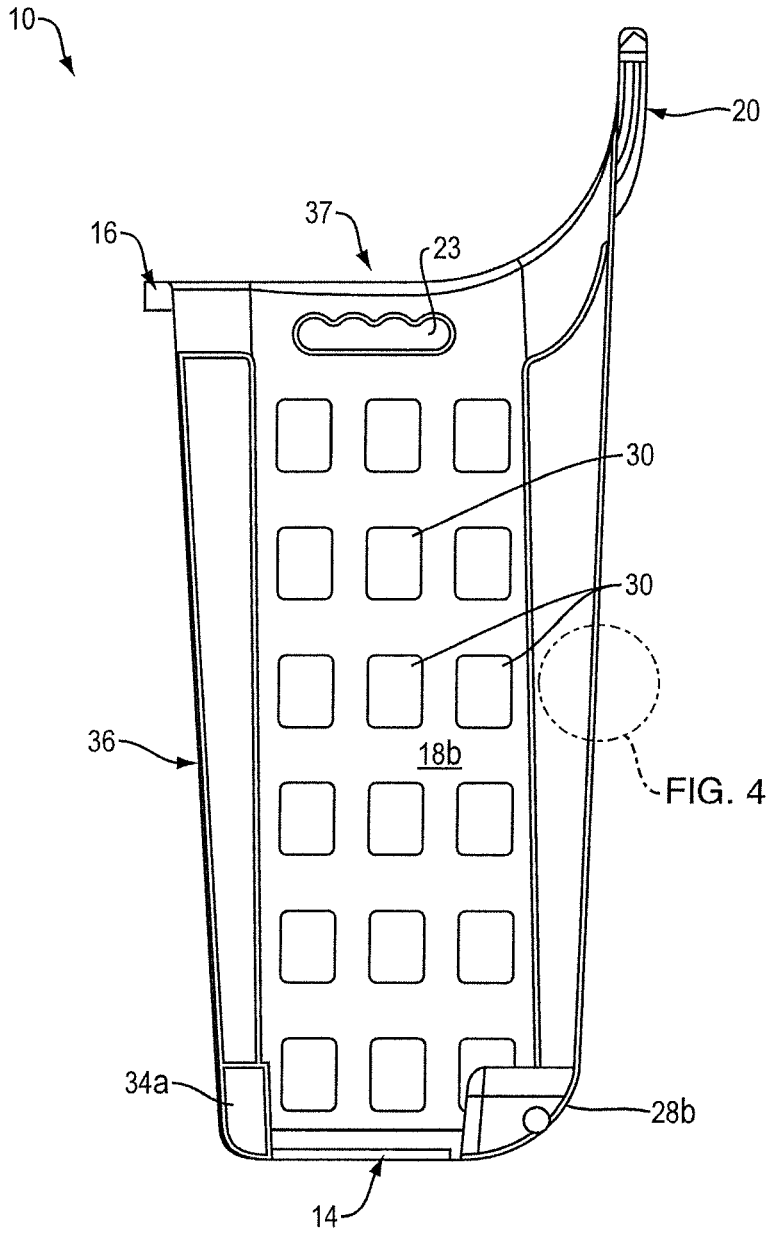
FIG. 3 is a cross-sectional view taken along line 3-3 from FIG. 2.

FIG. 3 shows the cross-sectional view 3-3 from FIG. 2. This side view depicts a side 18*b* as seen from inside the hamper 10. Also shown is a side view of wheel indentation 28*b* wherein a wheel/axle component (not shown) may be installed. A protrusion 34*b* is located at a corner where bottom 14, front portion 36 and side 18*b* meet. Protrusion 34*b* is the same general height from the bottom 14 as the top of wheel indentation 28*b* so that another identical hamper 10 may be supported on the tops of the two protrusions and the tops of the two indentations. This, together with the slightly inwardly-tapered front back and sides, allows the hampers to nest one within the other, for space-efficient storage of multiple hampers by users or retailers, for example. Ventilation holes 30 also exist throughout each side 18*a* and 18*b* of hamper 10 in order to allow airflow throughout the contents of hamper 10. The extended area 20 extends higher than the sides 18*a* and 18*b* and the front portion 36, when measured from the bottom 14, enabling the user to grasp the hamper 10 without the need to bend or crouch. The sides 18*a* and 18*b* and the front portion 36 are all the same height, when measured from the bottom 14, maximizing the holding content of the hamper 10, while also maintaining an easily usable height of the upper rim 16 for the deposition of clothing or other articles. The upper rim 16 curves away from body 11 of hamper 10 and then downward to provide a place for the user to insert his/her fingers. The upper rim 16 outlines or defines the open top 37 of the hamper. Side handle opening 23 is shown. There may be one in each of the two sides. The inverted U-shaped rim 16 just above opening 23 may be reinforced, for example with one, two, or more ribs (not shown) that span the distance between the two spaced walls that form the inverted U of rim 16.

Figure 4:
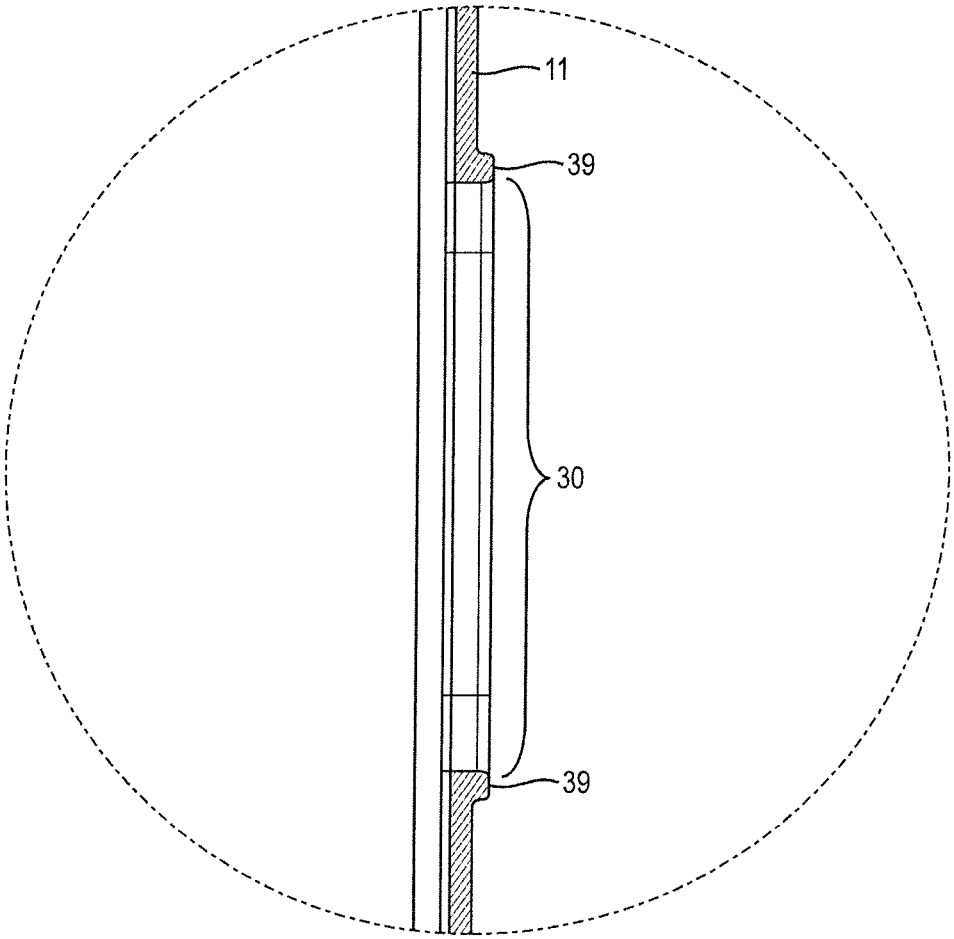
FIG. 4 is an enlarged view of detail "A" from FIG. 3.

FIG. 4 is an enlarged view of Detail A from FIG. 3. Reinforcement of one or more of the openings 30 is accomplished with a raised rim 39 around the edge of some or all of holes 30. Rim 39 provides strength to the edge of each of the holes 30, as well as a more of a rounded contour, to avoid sharp edges which may catch clothing or potential hazards for the user.

Figure 5:
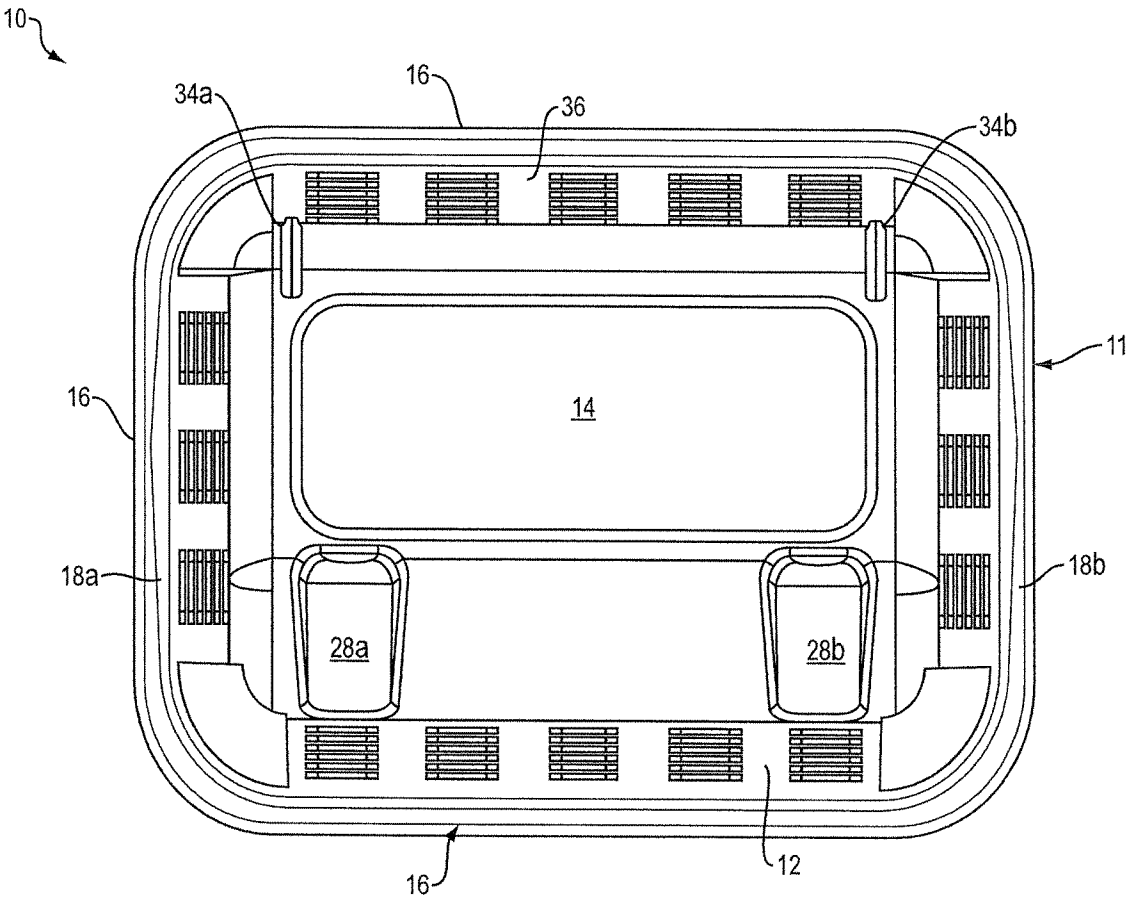
FIG. 5 is a top view of the hamper of FIGS. 1-4.

FIG. 5 shows the bottom 14, the two sides 18*a* and 18*b*, the front portion 36 and the rear portion 12 as seen when looking from above and into the open top of hamper 10. Two wheel indentations 28*a* and *b* can be see along the bottom 14 and the rear portion 12. Two protrusions 34*a* and *b* are near the corners created by the bottom 14, sides 18*a* and 18*b*, and the front portion 36. The protrusions 34*a* and *b* and the wheel indentations 28*a* and *b* support the bottom of another identical hamper that is fitted into (nested into) the hamper. The upper rim 16 is continuous along the tops of the front portion 36, the two sides 18, and the rear portion 12 of this embodiment.

Figure 6:
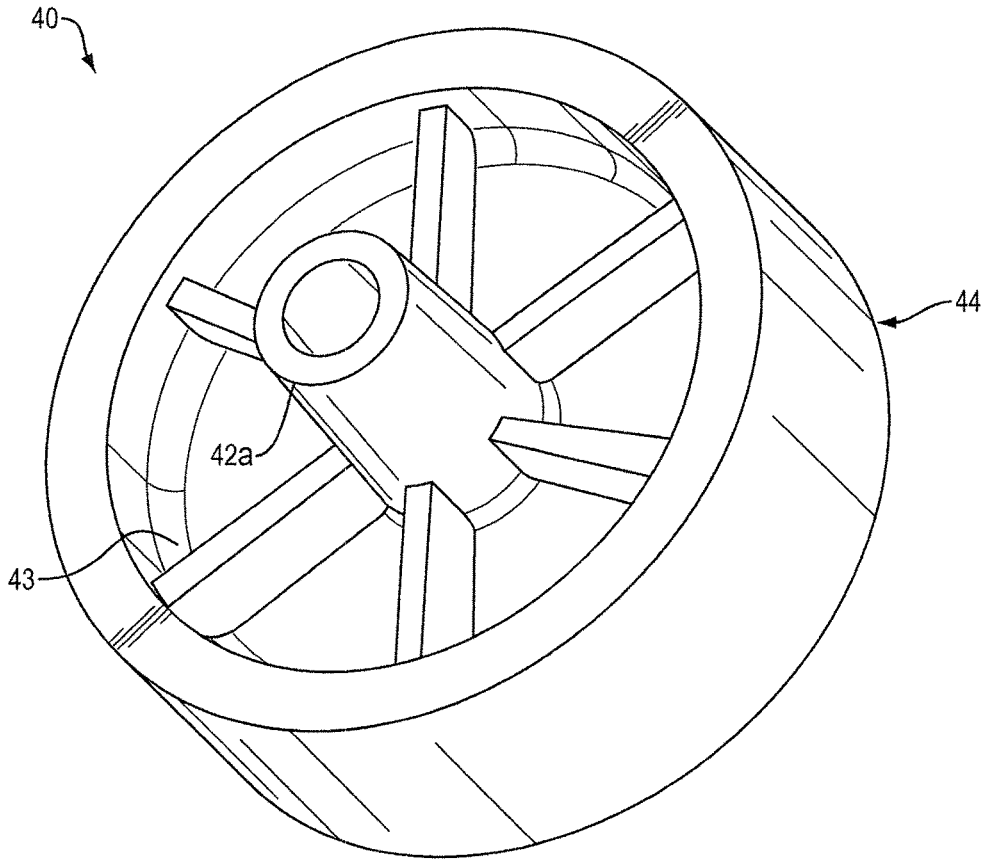
FIG. 6 is a perspective view of a wheel/axle component for the hamper.

FIG. 6 shows an embodiment of a unitary (one piece molded plastic) wheel/axle component 40 which may be used with the hamper. The wheel/axle component 40 comprises an axle 42*a* that projects outward from hub 43, and a wheel 44. Component 40 be a one-piece molded plastic device. Wheel 44 may have a variety of materials upon its exterior rolling surface (not shown), such as a rubberized exterior surface which allows the hamper to be used on a variety of floor surfaces in order to avoid possible marring and/or slipping.

Figure 7:
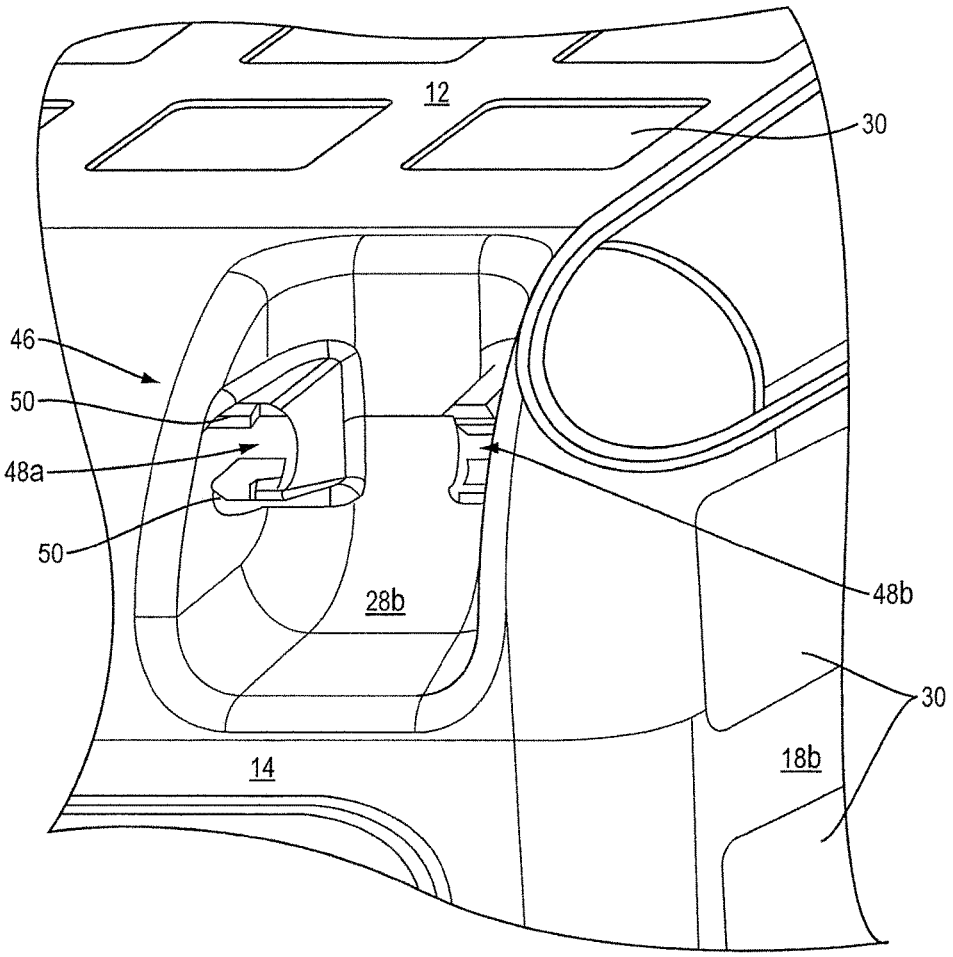
FIG. 7 is an enlarged partial perspective view of an axle retaining assembly within a wheel indentation for the hamper.

FIG. 7 is an enlarged a perspective of an axle retaining assembly 46 within a wheel indentation 28*b* located on the lower part of the rear portion 12 and toward the rear of the bottom 14 and at side 18*b*. Ventilation holes 30 can be seen throughout the rear portion 12 and the side 18*b*. The axle retaining assembly 46 includes a pair of axle retaining saddles 48*a* and 48*b* that the axles fit into and is manufactured with straight mold shut-offs, creating undercuts 50 which do not require additional undercut release devices. This design simplifies the mold construction and the molding process and it allows for a narrower wheel to be used if desired.

Figure 8:
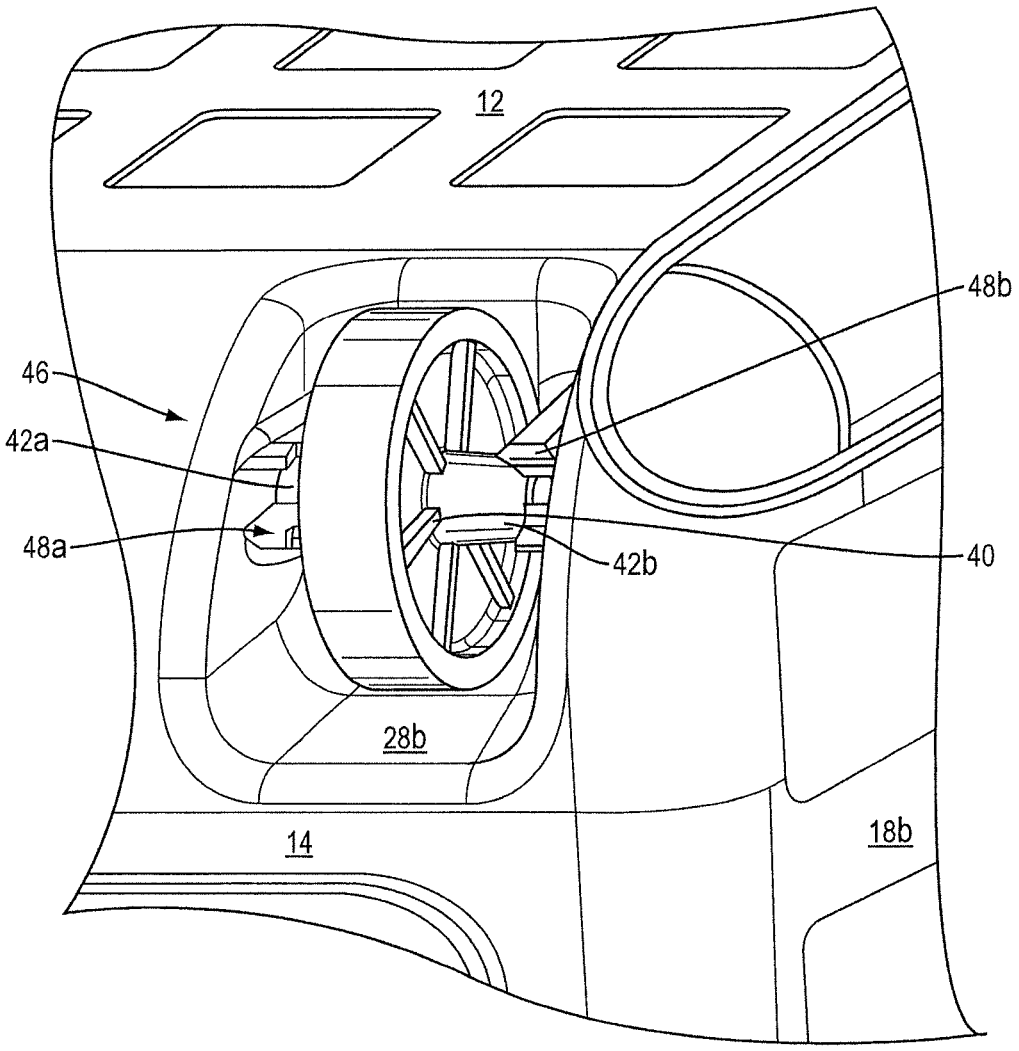
FIG. 8 is a perspective view of the wheel/axle of FIG. 6 secured within the axle retaining assembly of FIG. 7.

FIG. 8 shows the same perspective of an axle retaining assembly 46 as FIG. 7, with a wheel/axle component 40 installed within axle retaining saddles 48*a* and *b*, by axle 42*a* fitting into saddle 48*a* and axle 42*b* fitting into saddle 48*b*. The one-piece wheel/axle component 40 is easily snapped into place by each axle 42*a* and *b* snapping into a saddle 48*a* and *b*. The opening between saddle portions 50 is slightly smaller than the diameter of an axle such that portions 50 are slightly spread apart when the axle is inserted but then snap back in place (since they are made from plastic). This holds the axles in the saddles so that they do not fall out. The wheel can be removed by pulling the axles from the saddles. See FIGS. 10A-10C for more detail.

The wheel/axle component 40 and axle retaining saddles 48*a* and 48*b* that accomplish removable wheels can be used in products other than rolling hampers, such as rolling containers, waste baskets, dollies and other devices, particularly those in which the product should sit on the floor but then can be tipped and rolled. The ease and reduced cost of manufacture, the space efficiency provided to the end-use products, and the simplicity of installation and use make the wheel/axle component 40 and axle retaining saddles 48*a* and 48*b* combination highly attractive to manufacturers, retailers, and consumers.

Figure 9:
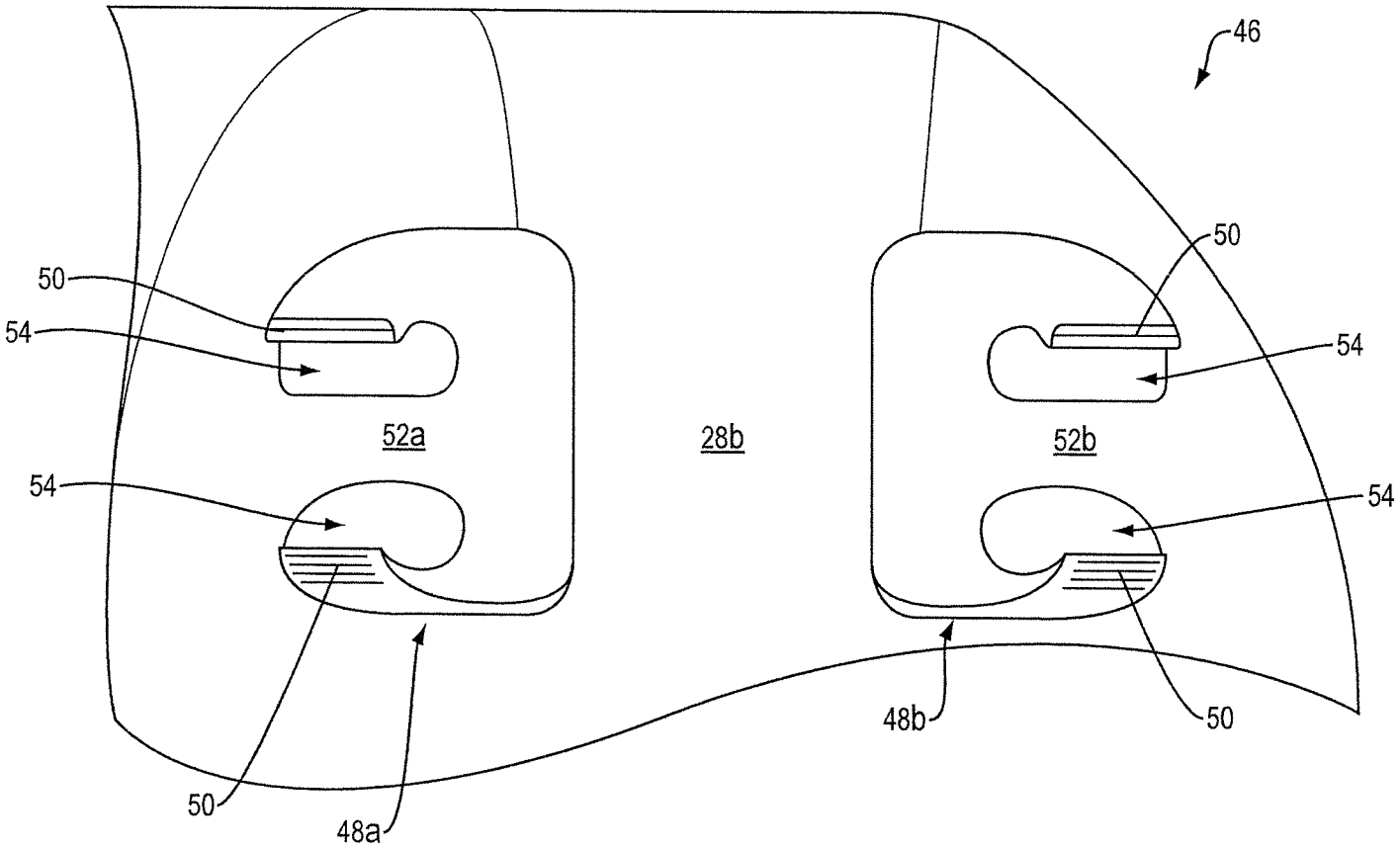
FIG. 9 is an enlarged front view of an axle retaining assembly.

FIG. 9 is an enlarged front view of axle retaining assembly 46 showing the two pairs of saddles 48*a* and 48*b*, all within wheel indentation 28*b*. The saddles retain an axle (not shown) after it has been snapped into place (as shown in FIG. 8). The axles sit against the two axle stops 52*a* and 52*b*. Gaps 54 are on either side of the axle stops 52*a* and *b*, leaving three points of contact to retain an axle: an axle stop 52*a* or 52*b*, and the two saddles.

Figure 10A:
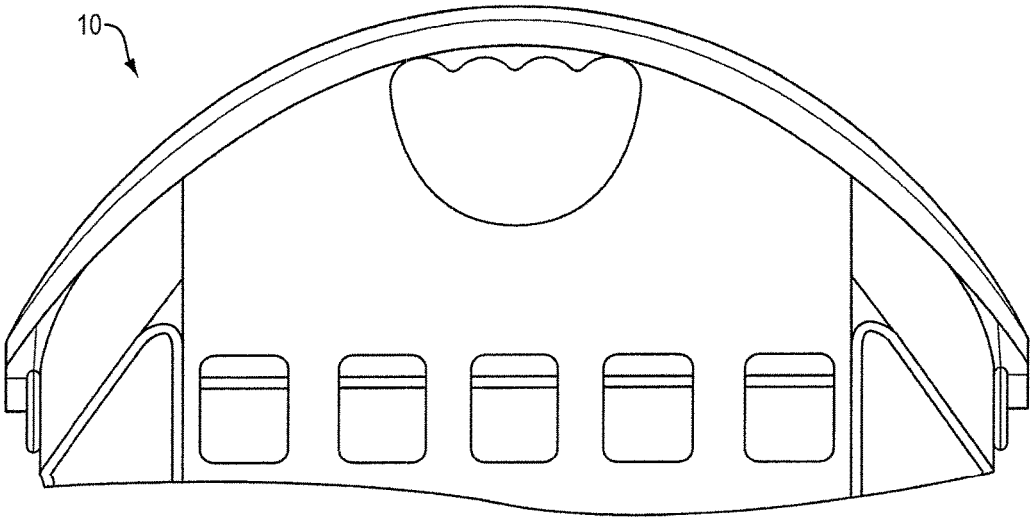
FIG. 10A is a rear view of the hamper.
Figure 10A:
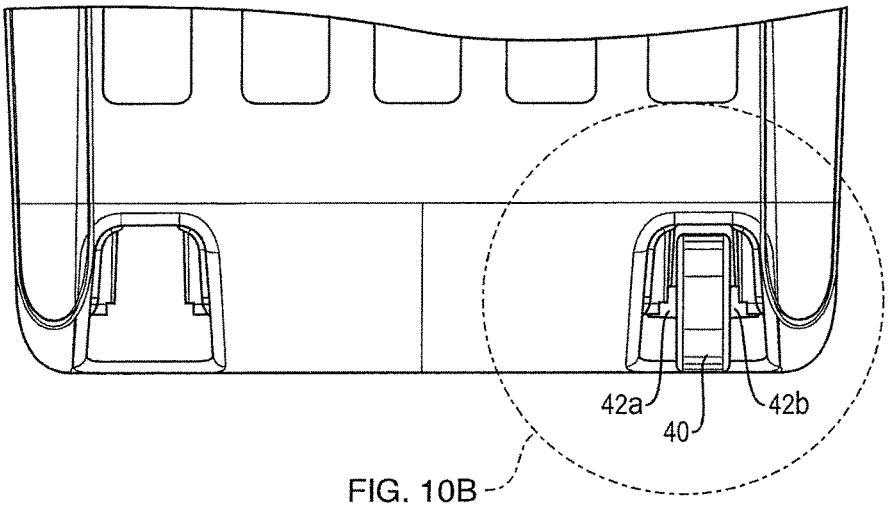
Figure 10B:
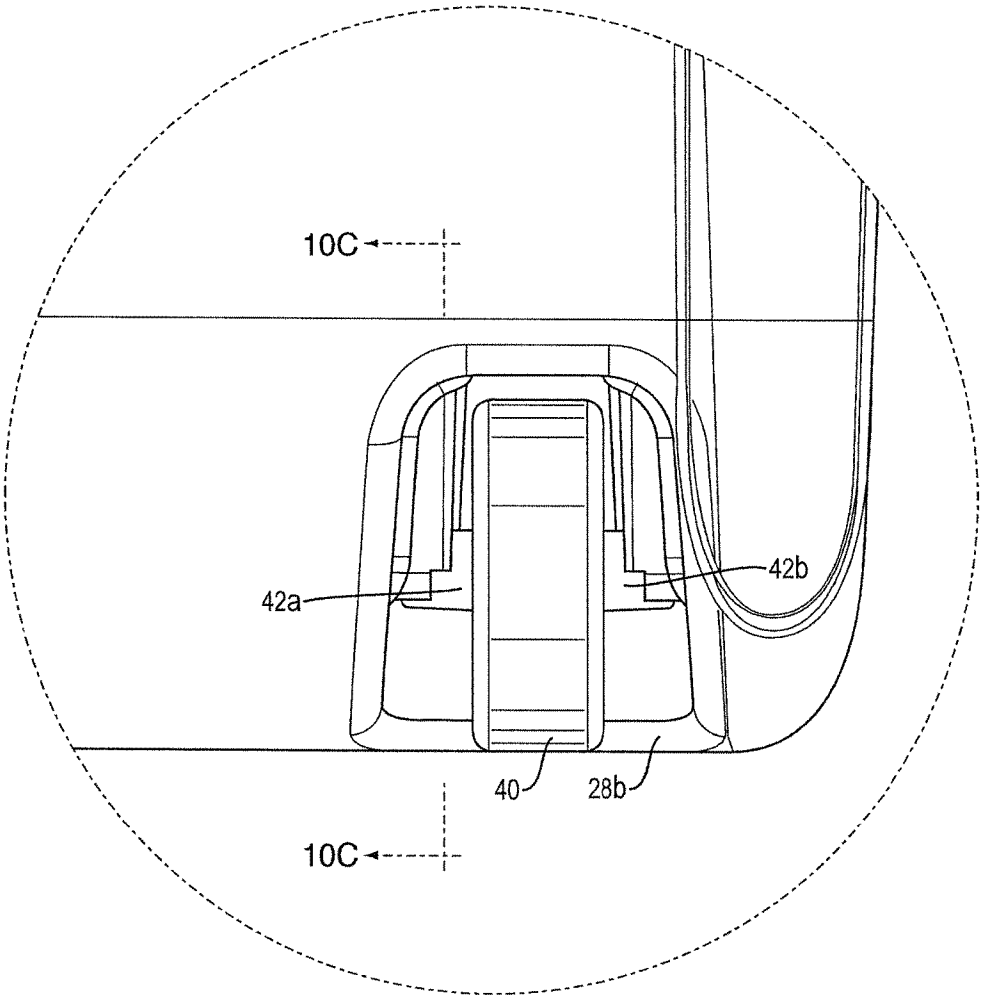
FIG. 10B is an enlarged view of detail "A" from FIG. 10A.
Figure 10C:
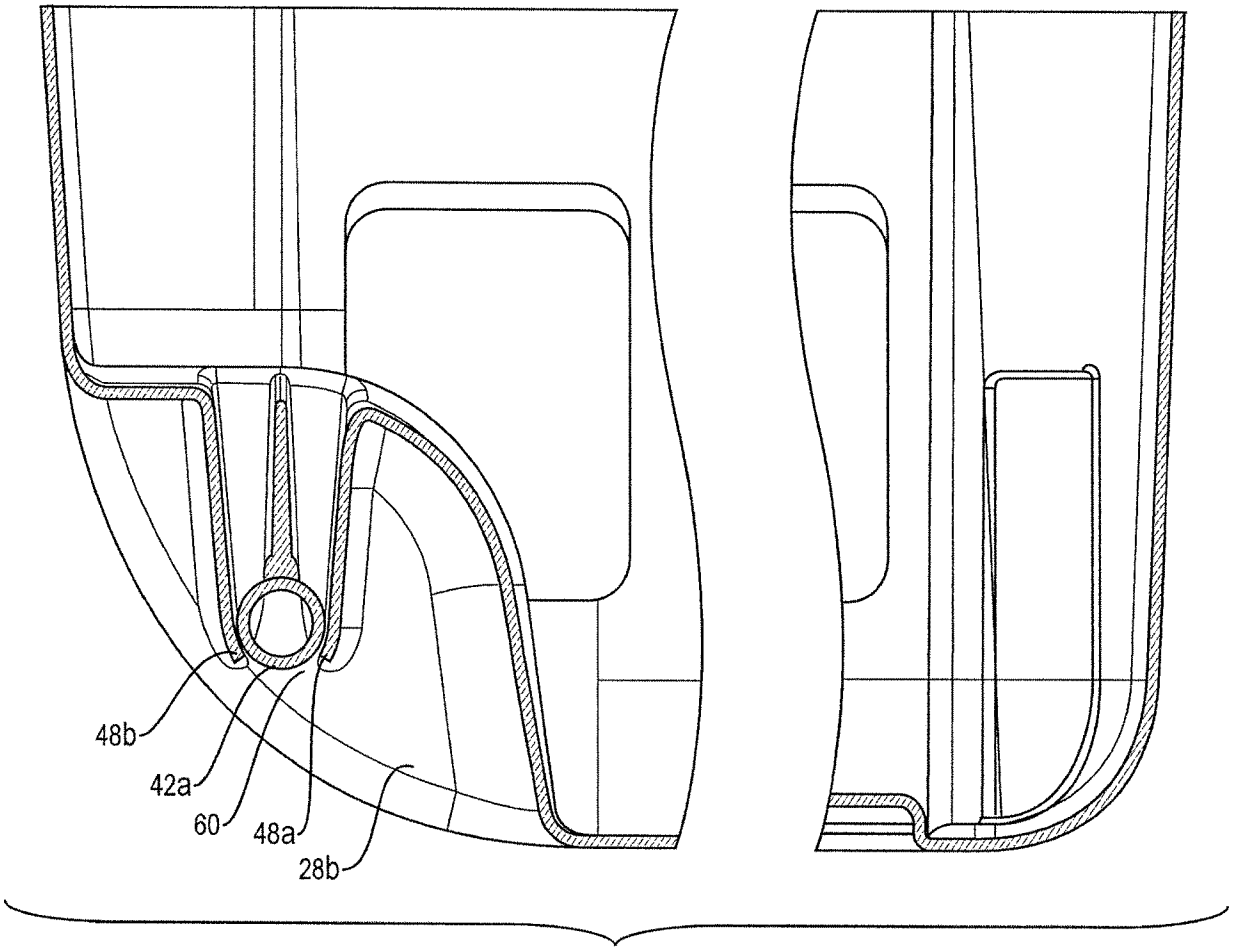
FIG. 10C is a cross-sectional view taken along line 10C-10C from FIG. 10B.

FIGS. 10A-10C illustrate more detail of the engagement of axles 42*a* and 42*b* with each pair of saddles 48*a* and 48*b*, and the undercut which defines a relaxed opening width (distance) 60 between opposed distal ends of saddles 48*a* and 48*b*, where this distance 60 is slightly less than the diameter of axle 42*a*.

A number of implementations have been described. Nevertheless, it will be understood that additional modifications may be made without departing from the scope of the inventive concepts described herein, and, accordingly, other embodiments are within the scope of the following claims.

What is claimed is:

1. A rolling hamper, comprising:

a one-piece plastic molded hamper body that has a rear portion, a front portion, a left side, a right side, an open top, and a bottom, where there is a first bottom rear corner at an intersection of the rear portion, the bottom and the left side, and there is a second bottom rear corner at an intersection of the rear portion, the bottom and the right side; and first and second wheel indentations located on a lower part of the rear portion, each wheel indentation having an axle retaining assembly, the assembly comprising:

a pair of axle retaining saddles separated by an opening, each saddle comprising two opposing saddle portions; and an axle stop adjacent to each pair of saddle portions, opposing the opening, and extending between the saddle portions; and a wheel with an axle around which an exterior surface rotates, the surface having a width;

wherein one wheel is removably coupled to the each of the axle retaining assemblies;

wherein the axle stops prevent the lateral movement of each axle, allowing an alternate wheel with an alternate width to be utilized within the opening between each pair of axle retaining saddles; and wherein the entirety of each axle retaining assembly is located within each respective first and second wheel indentation.

2. The rolling hamper of claim 1, wherein the hamper body further comprises a reinforced top rim that defines an upper edge of the rear portion, front portion, left side and right side.

3. The rolling hamper of claim 2, wherein the rear portion comprises a lower part and an expanded upper area, and the hamper body further comprises handle openings adjacent to the top rim of the rear portion and both sides.

4. The rolling hamper of claim 3, wherein the hamper body further comprises one or more ribs located on each side of the handle openings in the sides, to provide additional strength when the hamper is lifted by the handles.

5. The rolling hamper of claim 1, wherein the rear portion, front and side portions are inwardly tapered at a draft angle, so that multiple hampers can be nested one inside another.

6. The rolling hamper of claim 5, further comprising at least one protrusion on the bottom portion and extending upward toward the open top in order to support a nested hamper.

7. The rolling hamper of claim 6, wherein the protrusions are inside the hamper body at corners of the sides the front and the bottom.

8. The rolling hamper of claim 1, wherein the rear portion comprises a top section that extends above the front and sides.

9. The rolling hamper of claim 8, further comprising a handle opening in the top section of the rear portion, to accomplish an extended rear handle that helps the user to tip the hamper rear portion on the wheels so that it can be rolled.

10. The rolling hamper of claim 1, wherein the rear portion, front and sides each include multiple openings that allow for additional air flow into and through the hamper.

11. The rolling hamper of claim 10, wherein at least some of the openings are framed by a protruding rim on the outside of the hamper body that serves to strengthen the openings so they are less likely to tear, and also eliminate sharp edges around the openings on the outside of the hamper body.

12. The rolling hamper of claim 1, wherein the wheels are each constructed as a one piece molded unit.

13. The rolling hamper of claim 1, wherein the rear portion is longer than the front and side portions when measured from the bottom.

* * * * *